US010227741B1

(12) United States Patent
Husar

(10) Patent No.: US 10,227,741 B1
(45) Date of Patent: Mar. 12, 2019

(54) MILLING MACHINE INCLUDING AUXILIARY FLUID TANK

(71) Applicant: Caterpillar Paving Products Inc., Brooklyn Park, MN (US)

(72) Inventor: Lucian M. Husar, Rogers, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/826,208

(22) Filed: Nov. 29, 2017

(51) Int. Cl.
*E01C 23/088* (2006.01)
*B05B 9/04* (2006.01)
*B05B 9/00* (2006.01)

(52) U.S. Cl.
CPC ..... *E01C 23/088* (2013.01); *B05B 9/007* (2013.01); *B05B 9/0423* (2013.01); *E01C 2301/50* (2013.01)

(58) Field of Classification Search
CPC .... E01C 23/06; E01C 23/088; E01C 23/0885; E01C 23/09; E01C 23/0906; E01C 23/094; E01C 23/0946; E01C 23/096; E01C 23/0966; E01C 23/12; E01C 19/48; E01C 19/4853; E01C 19/486; E01C 19/4866; E01C 19/4873; E01C 19/46; E01B 27/10; E01B 27/02; E01B 27/027; E01B 27/028; B05B 9/007
USPC ..... 404/91, 101, 107, 75, 90–94, 76, 108, 404/111; 299/36.1, 39.1, 39.2, 41.1, 39.4
See application file for complete search history.

(56) References Cited

U.S. PATENT DOCUMENTS 4,072,435 A 2/1978 Coho et al.
4,325,580 A * 4/1982 Swisher, Jr. ..... B28D 1/186 299/39.8
4,588,231 A 5/1986 Silay et al.
5,544,971 A 8/1996 Huege et al.
9,457,653 B2 10/2016 Busley et al.
9,464,390 B2 10/2016 Kreutz

FOREIGN PATENT DOCUMENTS

CN 106245561 A 12/2016
DE 60018834 T2 2/2006
FR 1219355 * 5/1960

OTHER PUBLICATIONS

Chinese document 203452898 (Year: 2014).*

* cited by examiner

*Primary Examiner* — Sunil Singh
(74) *Attorney, Agent, or Firm* — Leydig, Voit & Mayer, LTD.

(57) ABSTRACT

A milling machine includes a frame carrying a rotatably-mounted drum in a drum enclosure, a primary reservoir, a pump fluidly associated with the primary reservoir and at least one auxiliary reservoir. The primary reservoir includes at least one fill port and is configured to receive fluid to be enclosed within the primary reservoir. The auxiliary reservoir is removably coupled to the frame, and includes at least one auxiliary air vent opening disposed in an upper portion. The air vent opening permits the passage of air as the auxiliary reservoir is filled and drained. At least one fluid connection fluidly coupled to a lower portion of the auxiliary reservoir fluidly couples the auxiliary reservoir to the primary reservoir. The primary reservoir and the at least one auxiliary reservoir are configured to equilibrate as the pump draws fluid from the primary reservoir.

20 Claims, 6 Drawing Sheets

MILLING MACHINE INCLUDING AUXILIARY FLUID TANK

TECHNICAL FIELD

This patent disclosure relates generally to milling machines and, more particularly, to fluid tanks for milling machines.

BACKGROUND

When resurfacing an asphalt road surface, at least a portion of the upper surface of the roadway is milled by specialized equipment so a new layer of asphalt can be deposited. The milling operation, which can also be referred to as cold planing, asphalt milling, or profiling, can be carried out at any desired depth depending on the resurfacing operation. Typically, a road surface is milled, and the material removed from the road is collected for recycling. Material suitable for recycling is ground and used as aggregate in new pavement. Milling operations in general are also used to control heights and clearances of other road structures such as curb reveals, manhole and catch basin heights, shoulder and guardrail heights, overhead clearances and the like in both finished and unfinished road surfaces.

Milling is generally performed by construction equipment called milling machines, such as cold planers and rotary mixers. These machines typically use a large rotating drum for removing and grinding the road surface. The drum is usually enclosed in a drum enclosure that shields the surroundings from flying debris and contains the milled material, which, in the case of at least a cold planer, is collected and deposited on a conveyor for loading onto a waiting truck. Many milling machines use an up-cut configuration, in which the drum rotates in the reverse direction to the drive wheel or tracks, which helps drive the milled material up and into a conveyor. This configuration also creates considerable amounts of dust and other airborne debris, which can be controlled by various methods including fluid spraying and using vacuum collectors. The fluid spray operates to cool the cutting drum and also help contain or settle dust. A typical milling machine will carry a reservoir onboard that feeds the fluid spray system. However, milling machines may operate in remote areas where fluid is not readily accessible and must be delivered by truck. Fluid replenishment also requires the machine to stop operation and thus increase the time required to complete a project.

SUMMARY OF THE DISCLOSURE

In one aspect, the disclosure describes a milling machine including a frame, a drum enclosure, and a drum positioned within the drum enclosure and arranged to rotate about a drum axis. The drum is carried by the frame and configured to plane a road surface during operation. The milling machine further includes a primary reservoir, a pump fluidly associated with the primary reservoir and configured to draw the fluid therefrom, and at least one auxiliary reservoir. The primary reservoir is mounted on the frame and configured to enclose a volume of fluid. The primary reservoir includes at least one fill port and is configured to receive fluid to be enclosed within the primary reservoir. The auxiliary reservoir is removably coupled to the frame, and includes at least one auxiliary air vent opening configured to permit the passage of air as the auxiliary reservoir is filled and drained. At least one fluid connection fluidly coupling the auxiliary reservoir to the primary reservoir. The primary reservoir and the at least one auxiliary reservoir are configured to equilibrate as the pump draws fluid from the primary reservoir.

In another aspect, the disclosure describes a milling machine that includes a frame, a drum enclosure, and a drum positioned within the drum enclosure and arranged to rotate about a drum axis. The drum is carried by the frame and configured to plane a road surface during operation. The milling machine also includes a primary reservoir mounted on the frame and configured to enclose a volume of fluid, a pump fluidly associated with and configured to draw fluid from the primary reservoir, and at least one auxiliary reservoir coupled to the frame. The primary reservoir includes at least one fill port configured to receive fluid to be enclosed within the primary reservoir. The auxiliary reservoir includes an upper portion, a lower portion, and at least one auxiliary air vent opening disposed in the upper portion. The at least one auxiliary air vent opening permits the passage of air as the at least one auxiliary reservoir is filled and drained. The milling machine also includes a sight gage fluidly coupled to the primary reservoir and the auxiliary reservoir. The sight gage includes a substantially transparent tube having an upper end and lower end. The sight gage further includes a lower fitting fluidly coupled with the lower end of the tube and with the primary reservoir, and an upper fitting fluidly coupling the upper end of the tube with the primary reservoir. A hose fluidly couples the lower portion of the auxiliary reservoir with the lower fitting of the sight gage whereby the sight gage fluidly couples the auxiliary reservoir and the primary reservoir to equilibrate fluid contained in the primary reservoir and the auxiliary reservoir as the pump draws fluid from the primary reservoir.

In yet another aspect, the disclosure describes a spray system for a milling machine including a drum rotatably mounted on a frame and configured to plane a road surface during operation. The spray system includes at least one spray bank, a primary reservoir, a pump, at least one auxiliary reservoir, and at least one fluid connection fluidly coupling a lower portion of the auxiliary reservoir to the primary reservoir. The at least one spray bank includes a spray manifold and a plurality of spray nozzles. The primary reservoir is configured to be mounted on the frame and to enclose a volume of fluid. The primary reservoir includes at least one fill port configured to receive fluid to be enclosed within the primary reservoir. The pump is fluidly associated with the primary reservoir and configured to draw the fluid therefrom and to supply fluid drawn from the primary reservoir to the at least one spray bank. The auxiliary reservoir is configured to be coupled to the frame, and includes at least one auxiliary air vent opening disposed in an upper portion of the auxiliary reservoir. The at least one auxiliary air vent opening permits the passage of air as the auxiliary reservoir is filled and drained. The primary reservoir and the at least one auxiliary reservoir are configured to equilibrate as the pump draws fluid from the primary reservoir.

DETAILED DESCRIPTION

Figure 1:
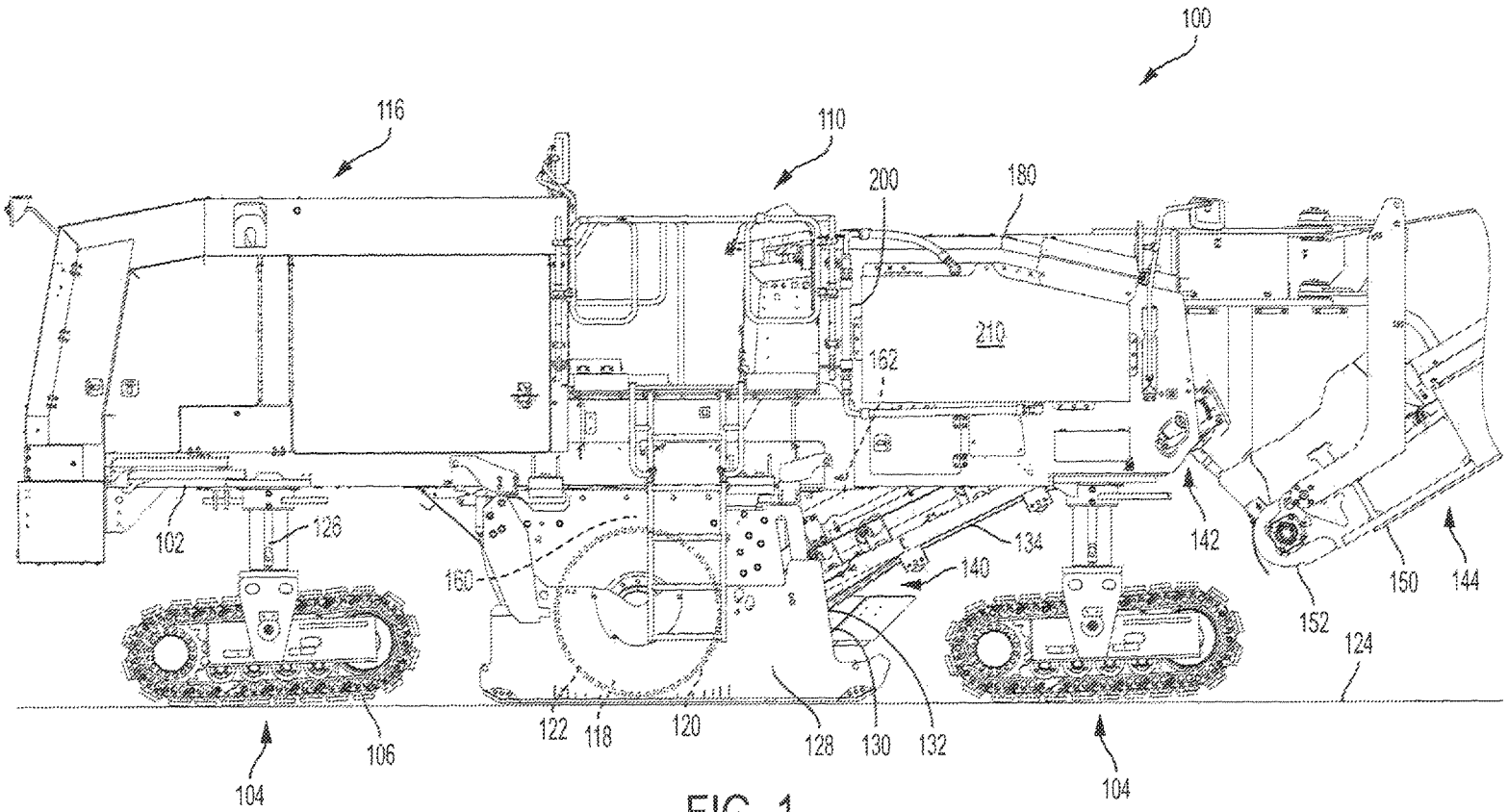
FIG. 1 is an outline view of a milling machine in accordance with the disclosure.
Figure 2:
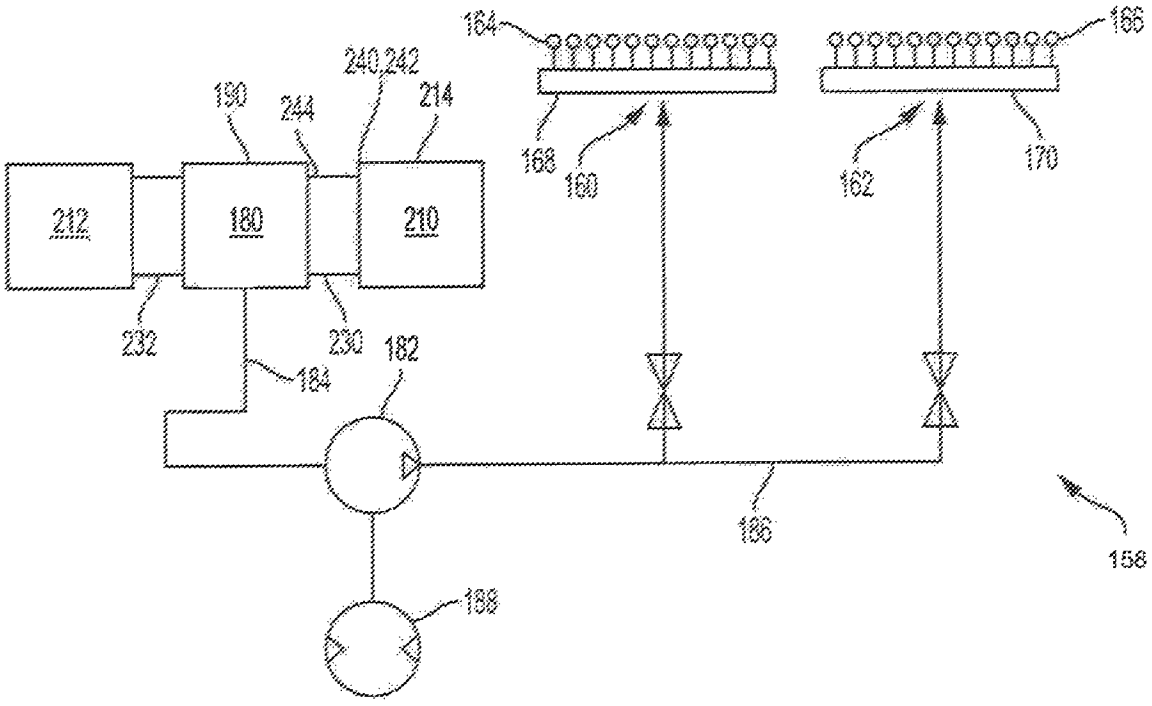
FIG. 2 is a schematic view of a spray system associated with the milling machine of FIG. 1.
Figure 3:
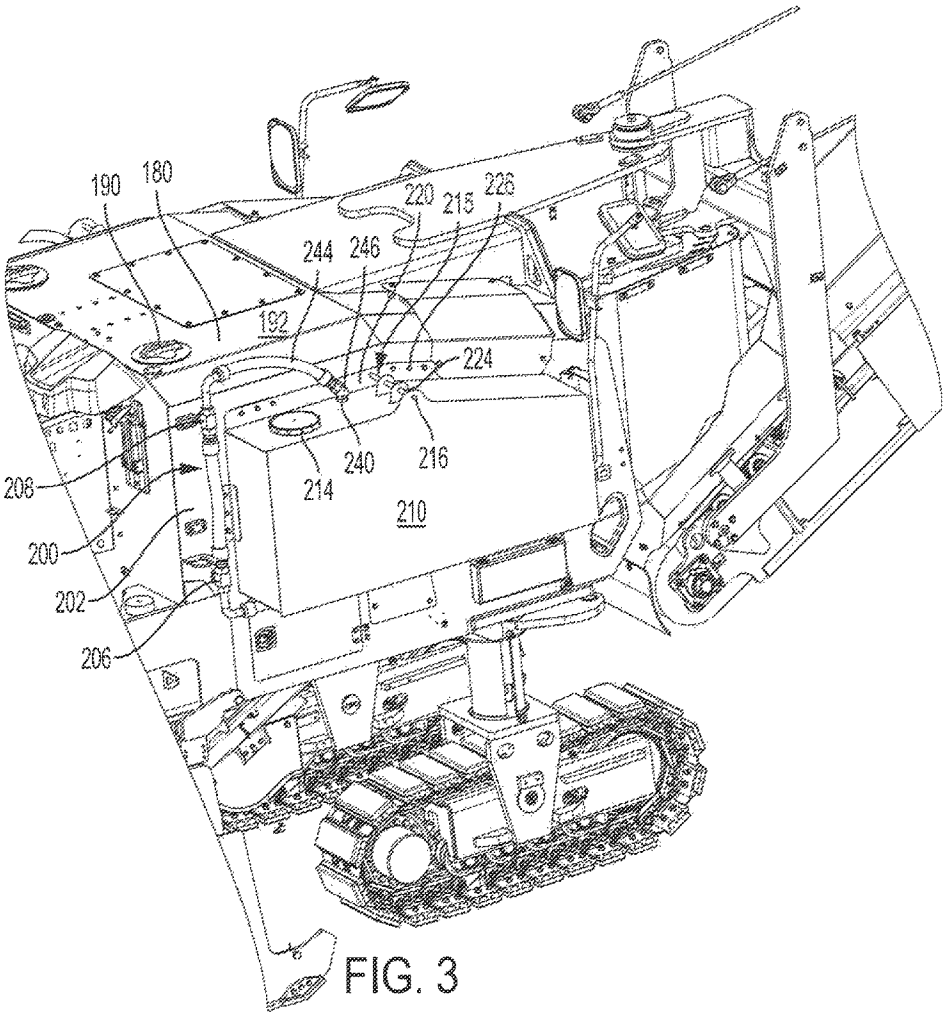
FIG. 3 is an enlarged, fragmentary, isometric view of the milling machine of FIG. 1 taken from an upper angle.

The present disclosure relates to fluid controls for milling machines and, more specifically, to reservoirs for milling machines, such as cold planers and rotary mixers. Referring now to the drawings, in which like reference numerals represent like parts throughout the several views, FIG. 1 shows a milling machine 100 in accordance with an embodiment. FIGS. 2 and 3 show fragmented, detailed views of certain operating portions of the milling machine 100. The milling machine 100 is generally of typical construction and includes a frame 102 supported by four (two visible) ground engaging members 104, the orientation and height of which relative to the frame 102 are selectively adjustable. Each ground engaging member 104 includes a track 106 (FIG. 3) that is powered in two directions by a hydraulic motor (not visible). Operation of the milling machine 100 can be carried out remotely by an operator, or locally from an operator portion 110. From the operator portion 110, an operator may manipulate various machine control devices such as one or more steering devices, a control panel that includes various control switches, and the like (not illustrated). The frame 102 further supports an engine (not shown) enclosed within an engine enclosure 116 and connected to various mechanical, hydraulic and/or electric systems operating the various portions of the milling machine 100.

For milling a road surface or any other surface, the milling machine 100 includes a milling drum 118 that is rotatably carried on the frame 102 and configured for powered rotation relative thereto during operation. The drum 118 has a generally cylindrical shape and includes a plurality of cutting elements or teeth 120 that are disposed about a peripherally outer portion 122 thereof and contact the ground, and perform cuts as the drum 118 rotates and the milling machine 100 advances along a surface 124 to be milled. In the illustrated embodiment, for example, as shown in FIG. 3, the drum 118 rotates in the direction of the arrow in a counter-clockwise direction as the machine moves in a forward direction towards the right side of the figure. A cutting depth of the drum 118 can be determined by a height-adjustment mechanism disposed between the drum 118 and the frame 102, but in the illustrated embodiment is controlled by controlling the height of the frame 102 with respect to the surface 124 by appropriately extending and retracting vertical actuators 126 (FIG. 3) disposed between the ground engaging members 104 and the frame 102.

Typically, the rotating drum 118 is enclosed within a shield or drum enclosure 128 that includes four walls surrounding the drum 118 around its sides, front and rear, and extend between the frame 102 and the ground or working surface 124. A front wall 130 of the drum enclosure 128 includes an opening 132, through which an intermediate stage conveyor 134 extends. The intermediate stage conveyor 134 is embodied in the illustrations as an endless-type conveyor that includes a conveyor belt (not visible) that continuously circulates around rollers (not visible), at least one of which is powered. The intermediate stage conveyor 134 has an input side 140, which is disposed close to the drum 118, and an output side 142, which is disposed further in the forward direction and higher relative to the frame 102 than the input side 140.

During operation, debris milled from the surface 124 by the rotating drum 118 is flung or otherwise directed towards the input side 140 of the intermediate conveyor 134 such that material removed from the surface 124 can be deposited on the belt (not visible). A final stage conveyor 144 is disposed adjacent the output side 142 of the intermediate stage conveyor 134. While a fragmentary portion of the final stage conveyor 144 is illustrated, it will be appreciated that the final stage conveyor 144 includes an elongated structure, and is configured to receive material for delivery to a location off the milling machine 100, for example, into a leading truck (not shown), in the customary fashion. More specifically, the final stage conveyor 144 is arranged as an endless conveyor that includes a belt (not visible) circulating around rollers (not visible), at least one of which is powered. The final stage conveyor 144 includes a frame 150 that is pivotally connected at one end 152 to the frame 102 such that it can rotate and pivot relative to the frame 102 during operation. The one end 152, which is also an input side of the final stage conveyor 144, is disposed beneath the output side 142 of the intermediate stage conveyor 134 to receive material therefrom, which is then dropped off an output side (not shown) of the final state conveyor 144 into a waiting truck bed (not shown).

To control dust and airborne debris during operation, and to also lubricate and cool the drum 118, the milling machine 100 includes various sprays disposed to deliver a fluid spray of a predetermined pattern and flow rate to various operating portions of the machine. While the fluid is typically water, the fluid may be any appropriate fluid and may, for example, include additives. The milling machine 100 may include a variety of sprayer configurations providing fluid sprays at a variety of locations. An exemplary sprayer configuration and fluid distribution assembly 158 are illustrated in the embodiment of FIG. 2. Those of skill in the art will appreciate that one or more spray banks 160, 162 including one or more spray nozzles 164, 166 may be arranged along one or more spray manifolds 168, 170 within the milling machine 100. While spray banks 160, 162 with the and associated spray nozzles 164, 166 and spray manifolds 168, 170 are disposed adjacent the drum 118 and a portion of the conveyor 134, spray banks may alternatively or additionally be provided.

The fluid is drawn from a primary reservoir 180 by a pump 182 through a supply pipe 184, and delivered on to the spray banks 160, 162 through a main distribution manifold 186. The illustrated pump 182 is embodied as a variable-speed pump, which can control the flow and/or pressure of fluid to any appropriate fluid distribution and spray arrangement utilized. Although the pump 182 is a variable-speed pump in the embodiment shown in FIG. 2, other pump types may be used, including variable-displacement and positive-displacement pumps may be used to control the flow and/or pressure of fluid provided to the main distribution manifold 186. The pump 182 may be driven by any appropriate mechanism, including, for example, a variable-speed hydraulic motor 188.

Returning to FIG. 3, the primary reservoir 180 may be of any appropriate design so long as it is supported by the frame 102. In order to facilitate filling the primary reservoir 180 with fluid, the primary reservoir 180 may include a fill port 190 that is typically provided along an upper surface 192. The primary reservoir 180 may further be provided with a visual indicator of the fill level of the primary reservoir 180, that is, the level to which the primary reservoir 180 is filled. In the illustrated embodiment, a sight gage 200 is provided along a side wall 202 of the primary reservoir 180. Disposed toward a forward end of the primary reservoir 180, the sight gage 200 is visible to an operator within the operator portion 110 of the cold planning machine 100, and provides a visual indication of the fluid fill level of the primary reservoir 180.

The illustrated sight gage 200 includes a generally vertically disposed, clear or substantially transparent, elongated tube 204 that is fluidly coupled to the primary reservoir 180 by fittings 206, 208 disposed at either end. In this way, the level of fluid within the sight gage 200 equilibrates with the fluid within the primary reservoir 180 as fluid flows through the fitting 206 and air flows through the fitting 208. It will be appreciated, however, that an alternative sight gage may be provided. Additionally, while the sight gage 200 is fluidly coupled with and extends from a side wall 202 of the primary reservoir 180, it will be appreciated that the sight gage 200 may be alternatively disposed and have an alternative design.

According to this disclosure, there is provided at least one removable auxiliary reservoir 210 that is fluidly coupled to the primary reservoir 180. While only one such auxiliary reservoir is visible in FIGS. 1, 3 and 4, it will be appreciated by those of skill in the art that a second such auxiliary reservoir 212 may be provided along the opposite side of the milling machine 100, as illustrated in FIG. 2, for example.

The auxiliary reservoir(s) 210, 212 may be of any appropriate design and shape. The auxiliary reservoir 210, 212 encloses a volume for holding a fluid for fluid connection to one or more manifolds 168, 170 supplying fluid to spray nozzles 164, 166. The auxiliary reservoir 210, 212 is configured to hold a volume of fluid, and may include an auxiliary fill port 214. The auxiliary reservoir 210, 212 may include structure to facilitate handling of the auxiliary reservoir 210, 212 during installation or the like. For example, in the illustrated embodiment, the auxiliary reservoir 210 is provided with a handle-like structure 215 that includes a rod 224 extending through a number of support flanges 216.

The auxiliary reservoir 210, 212 may be coupled to the milling machine 100 and supported by the frame 102 by any appropriate arrangement. By way of example, the illustrated auxiliary reservoir 210 is coupled along an external surface of the primary reservoir 180, in this embodiment, to a side wall 202 of the primary reservoir 180. In the illustrated embodiment, in order to couple the auxiliary reservoir 210 to the primary reservoir 180, the auxiliary reservoir 210 is provided with a plurality of attachment flanges 220, 222.

The attachment flanges 220, 222 in this embodiment are disposed to couple the upper end of the auxiliary reservoir 210 and the lower end of the auxiliary reservoir 210 to the primary reservoir. Openings in the attachment flanges 220, 222 receive fasteners 226, here, bolts, that extend through the attachment flanges 220, 222 into a wall of the milling machine 100, for example, the primary reservoir 180, to couple the auxiliary reservoir 210 to the frame 102. In this embodiment, the auxiliary reservoir 210 is removably coupled to the primary reservoir 180. In this way, a milling machine 100 may be optionally fitted with one or more auxiliary reservoirs 210, 212 in order to increase the volume of fluid carried by the milling machine 100.

The auxiliary reservoir 210, 212 is additionally fluidly coupled to the primary reservoir 180 by at least one fluid connection 230, 232. In the embodiment illustrated in FIGS. 1 and 4, the fluid connection 230 includes a hose, which may be flexible or rigid. The fluid connection 230, 232 is fluidly coupled to a lower portion of the auxiliary reservoir 210, 212 such that fluid may flow from the auxiliary reservoir 210, 212 to the primary reservoir 180. In the illustrated embodiment, the fluid connection 230 is fluidly coupled through a bottom surface 234 of the auxiliary reservoir 210. It will be appreciated, however, that the fluid connection 230, 232 could alternatively be fluidly coupled through a lower portion of a wall of the auxiliary reservoir 210, 212.

The fluid connection 230, 232 is likewise fluidly coupled to the primary reservoir 180. As with the auxiliary reservoir 210, 212, the fluid connection 230, 232 is fluidly coupled to a lower portion of the primary reservoir 180 such that fluid may flow and equilibrate between the auxiliary reservoir 210, 212 and the primary reservoir 180. Because the primary reservoir and the auxiliary reservoir 210 212 equilibrate, it will be appreciated that the sight gage 200 provides a visual indication not only of the fluid fill level of the primary reservoir 180, but also of the auxiliary reservoir 210, 212.

In the illustrated embodiment, the fluid connection 230 is fluidly coupled through a side wall 202 of the primary reservoir 180 at or near its lower end. While the fluid connection 230 could alternatively be fluidly coupled to the auxiliary reservoir 210 and the primary reservoir 180, by disposing the fluid connection 230 through the wall 202 near the bottom of the primary reservoir 180 and the lower portion of the auxiliary reservoir 210, the fluid connection 230 may facilitate a free flow of fluid between the auxiliary reservoir 210 and the primary reservoir 180 in some manners of mounting the auxiliary reservoir 210 with the primary reservoir 180.

In the illustrated embodiment, the fluid connection 230 is advantageously coupled to the primary reservoir 180 with the fitting 206 adjacent the sight gage 200. That is, an original elbow fitting (not shown) of the primary reservoir 180 may be removed and replaced with a fitting 206, such as a T-fitting, fluidly coupled to the primary reservoir 180. It will be appreciated that T-fittings may include three openings for connection to provide fluid communication. In an alternate embodiment, the original fitting (not shown) of the primary reservoir 180 maybe supplemented with a fitting that permits attachment to the fluid connection 230.

The auxiliary reservoir 210 additionally includes at least one auxiliary air vent having an auxiliary air vent opening in an upper portion of the auxiliary reservoir 210 in order to facilitate equilibration between fluid contained in the auxiliary reservoir 210 and fluid contained in the primary reservoir 180. Those of skill in the art will appreciate that the auxiliary air vent may be disposed at any appropriate location, and that multiple such air vents may be provided. For example, the auxiliary air vent may be disposed through an opening in an optional fill port 214 in the auxiliary reservoir 210. In the illustrated embodiment, the auxiliary air vent 240 includes an auxiliary air vent opening 242 in an upper portion of the auxiliary reservoir 210. To further facilitate equilibration between the fluids contained in the auxiliary reservoir 210 and the primary reservoir 180, the auxiliary air vent 240 may be fluidly coupled to the primary reservoir 180. In this embodiment, a vent tube 244 is fluidly coupled to the auxiliary air vent opening 242 and to the primary reservoir 180. The vent tube 244 is coupled to the auxiliary air vent opening 242 at fitting 246, and to the primary reservoir 180 by way of fitting 208. In this way, fluid may flow between the auxiliary reservoir 210 and the primary reservoir 180 by way of fluid connection 230, and air may flow between the auxiliary reservoir 210 and the primary reservoir 180 by way of the vent tube 244, permitting the fluid levels between the auxiliary reservoir 210 and the primary reservoir 180 to equilibrate. While only one vent tube 244 is illustrated, it will be appreciated that multiple such vent tubes may be provided.

While the auxiliary air vent 240 may be fluidly coupled to the primary reservoir 180 by an alternate arrangement, the auxiliary air vent 240 may be advantageously fluidly coupled to the primary reservoir 180 with the fitting 208 adjacent the sight gage 200. That is, an original elbow fitting (not shown) of the primary reservoir 180 may be removed and replaced with a fitting 208, such as a T-fitting, fluidly coupled to the primary reservoir 180. In an alternate embodiment, the original fitting (not shown) of the primary reservoir 180 maybe supplemented with a fitting that permits attachment to the vent tube 244.

Figure 4:
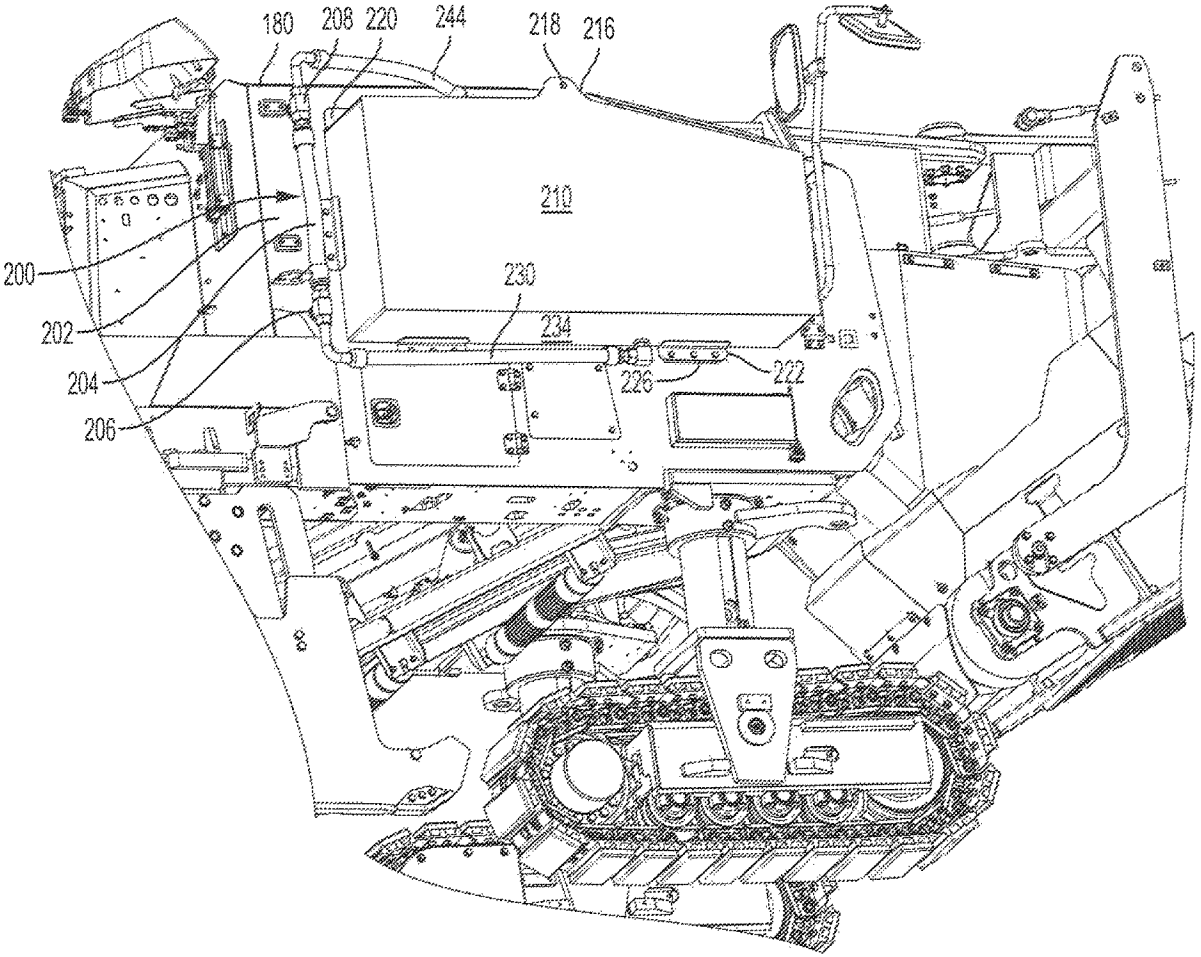
FIG. 4 is an enlarged, fragmentary, isometric view of the milling machine of FIGS. 1 and 3 taken from a lower angle.
Figure 5:
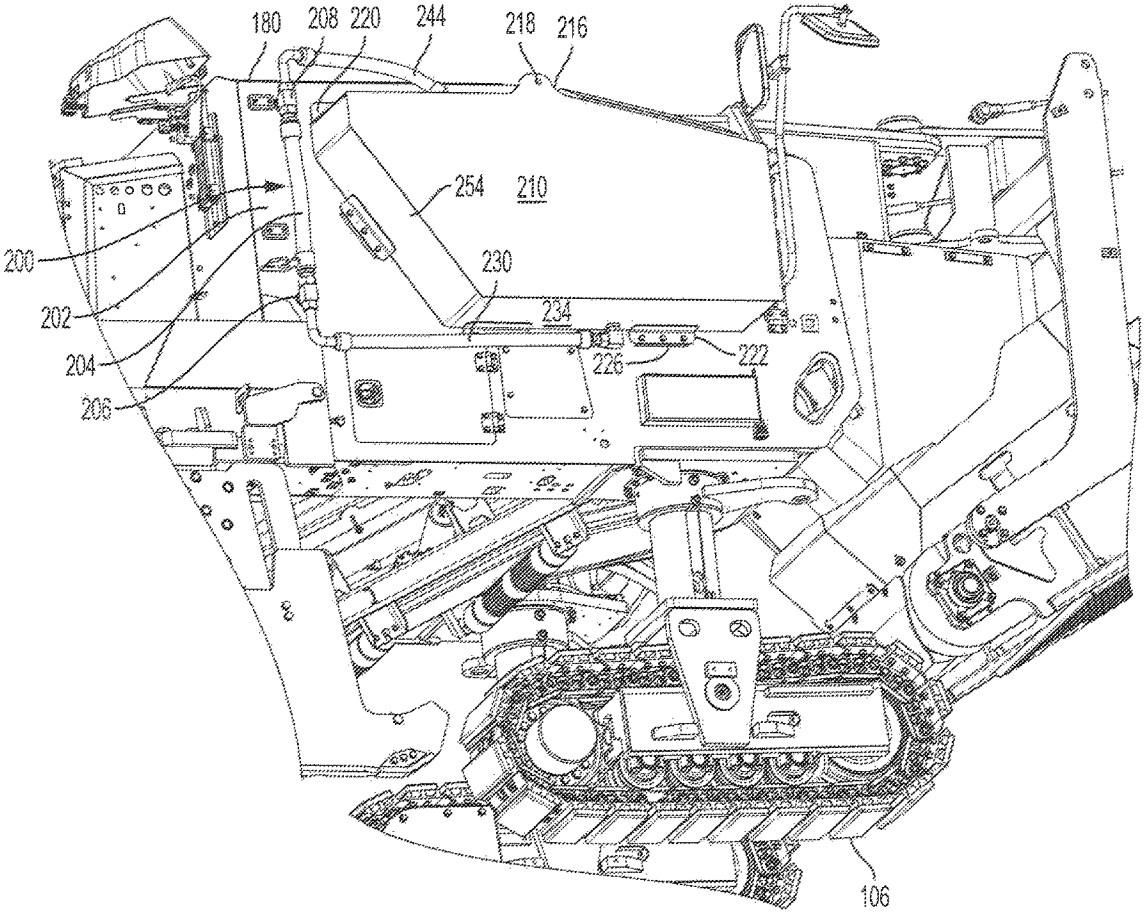
FIG. 5 is an enlarged, fragmentary, isometric view of an alternative embodiment of a milling machine taken from a lower angle.

Turning to FIG. 5, there is illustrated an alternative embodiment of the milling machine 100 illustrated in FIG. 4. In this embodiment, in order to enhance a sight line to a forward portion of the milling machine 100, a rearward wall 254 of the auxiliary reservoir 210 may be chamfered or angled toward the forward portion of the milling machine 100, including a forward track 106 of the milling machine 100. All other elements of the milling machine 100 are the same as described with regard to the embodiment of FIGS. 1-4.

Figure 6:
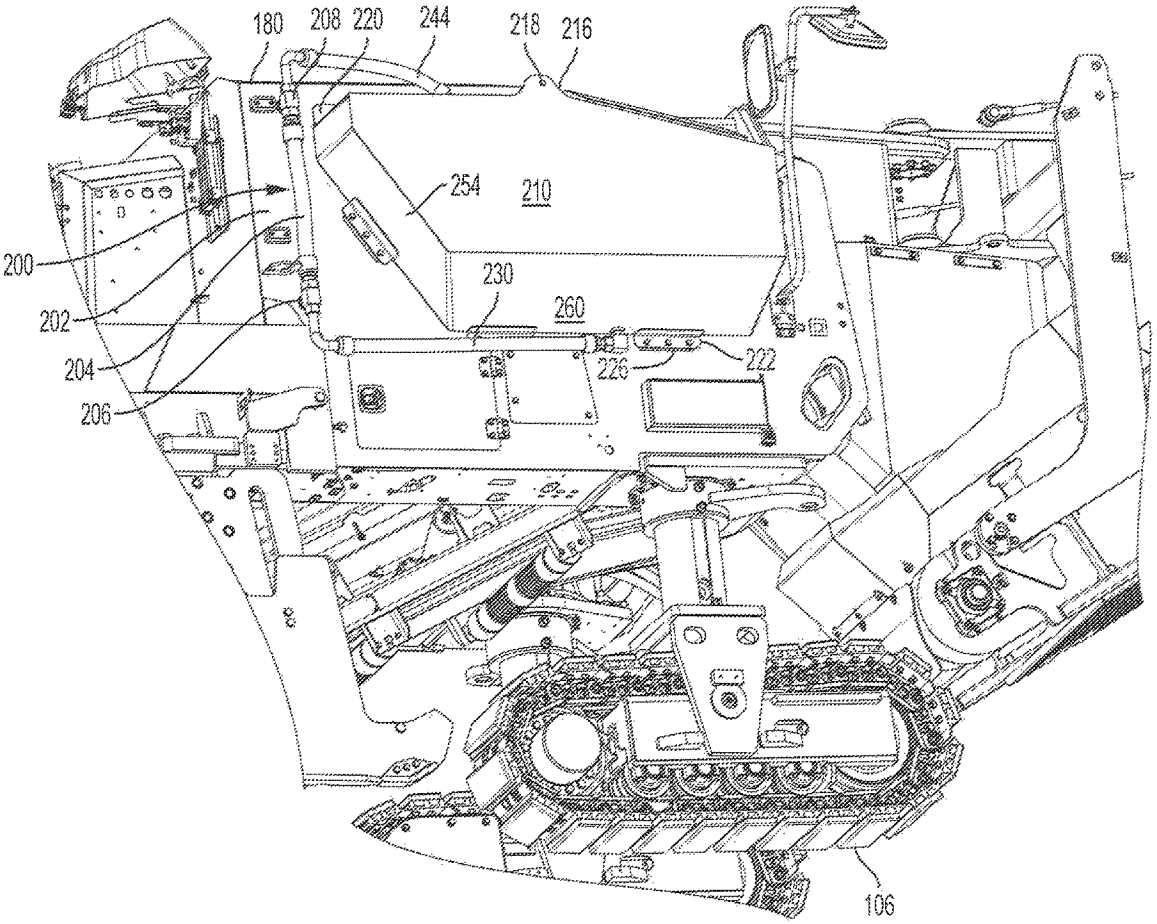
FIG. 6 is an enlarged, fragmentary, isometric view of another alternative embodiment of a milling machine taken from a lower angle.

In yet another embodiment illustrated in FIG. 6, a lower wall 260 of at least one auxiliary reservoir 210 may alternatively or additionally be angled upward, further enhancing an operator's view to a forward portion of a milling machine 100. As with the embodiment of FIG. 5, it will be appreciated that other structure of the auxiliary reservoirs 210 and the milling machine 100 may be as described with regard to the embodiment illustrated in FIGS. 1-5.

INDUSTRIAL APPLICABILITY

In some embodiments, a milling machine 100 may be advantageously retrofit with one or more auxiliary reservoirs 210, 212. In some embodiments, such retrofitting may be accomplished in the field, minimizing down time.

In some embodiments, one or both of the fluid connection 230, 232 and the auxiliary air vent 240 may be fluidly coupled to the primary reservoir 180 by replacement of existing fittings on the primary reservoir 180. For example, the fittings at the upper and lower ends of a sight gage 200 may be replaced or supplemented with fittings 206, 208 that may further be coupled to the auxiliary reservoir 210, 212 by way of the vent tube 244 and/or the fluid connection 230, 232.

The use of some embodiments may facilitate improvements in the length of time of operation of the milling machine 100 between refills. In some embodiment, the length of time of operation between refills may be improved on the order of 50%.

While the arrangement of this disclosure is explained generally with regard to an auxiliary reservoir 210 disposed along one side of the milling machine 100, such an auxiliary reservoir 212 may be provided along the opposite side of the milling machine 100, as illustrated, for example, in FIG. 2. In such an arrangement, the auxiliary reservoir 212 may be, for example, a mirror image of the auxiliary reservoir 210 illustrated and similarly fluidly coupled.

In some embodiments, both the primary reservoir 180 and the auxiliary reservoir(s) 210, 212 may be filled through a single fill port 190, 214. In some embodiments, both the primary reservoir 180 and the auxiliary reservoir(s) 210, 212 may be filled through either or both the fill port 190 of the primary reservoir 180, or the optional fill port 214 of the auxiliary reservoir 210, 212.

In some embodiments, fluid may be directed to one or more spray banks 160, 162 from one of the primary reservoir 180 or auxiliary reservoir(s) 210, 212, while fluid equilibrates between the primary reservoir 180 and the auxiliary reservoir(s) 210, 212. Thus, in some embodiments, the original fluid distribution assembly 158 may receive fluid from the primary reservoir 180, while the primary reservoir 180 receives fluid from the auxiliary reservoir(s) 210, 212.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

I claim:

1. A milling machine comprising:

a frame;

a drum enclosure;

a drum positioned within the drum enclosure and arranged to rotate about a drum axis, the drum being carried by the frame and configured to plane a road surface during operation;

a primary reservoir mounted on the frame and configured to enclose a volume of fluid, the primary reservoir including at least one fill port configured to receive fluid to be enclosed within the primary reservoir;

a pump fluidly associated with the primary reservoir and configured to draw the fluid from the primary reservoir;

at least one auxiliary reservoir configured to enclose a second volume of fluid, the at least one auxiliary reservoir being removably coupled to the frame and including at least one auxiliary air vent opening configured to permit the passage of air as the at least one auxiliary reservoir is filled and drained; and at least one fluid connection fluidly coupling the auxiliary reservoir to the primary reservoir;

such that the second the volume of fluid within the at least one auxiliary reservoir equilibrates with the volume of fluid within the primary reservoir as the pump draws fluid from the primary reservoir.

2. The milling machine of claim 1 wherein the primary reservoir and the at least one auxiliary reservoir are configured to equilibrate through the at least one fluid connection such that both the primary reservoir and the at least one auxiliary reservoir may both be filled through the at least one fill port.

3. The milling machine of claim 1 further including at least one vent tube fluidly coupling the at least one auxiliary air vent with the primary reservoir.

4. The milling machine of claim 1 wherein the at least one auxiliary reservoir is coupled to an external surface of the primary reservoir.

5. The milling machine of claim 1 including at least two auxiliary reservoirs, at least two auxiliary reservoirs being removably coupled to the frame along opposite sides of the milling machine.

6. The milling machine of claim 1 further including a sight gage, the sight gage providing a visual indication of a fluid fill level of primary reservoir.

7. The milling machine of claim 6 wherein the sight gage is fluidly coupled with and extends from an external surface of the primary reservoir, and the at least one fluid connection is fluidly coupled to the sight gage.

8. The milling machine of claim 7 further including at least one vent tube fluidly coupling the at least one auxiliary air vent opening with the sight gage.

9. The milling machine of claim 1 wherein the at least one auxiliary reservoir includes an auxiliary fill port, wherein the primary reservoir and the at least one auxiliary reservoir are configured to equilibrate through the at least one fluid connection such that both the primary reservoir and the at least one auxiliary reservoir may both be filled through the auxiliary fill port.

10. A milling machine comprising:

a frame;

a drum enclosure;

a drum positioned within the drum enclosure and arranged to rotate about a drum axis, the drum being carried by the frame and configured to plane a road surface during operation;

a primary reservoir mounted on the frame and configured to enclose a volume of fluid, the primary reservoir including at least one fill port configured to receive fluid to be enclosed within the primary reservoir;

a pump fluidly associated with the primary reservoir and configured to draw the fluid from the primary reservoir;

at least one auxiliary reservoir coupled to the frame, the at least one auxiliary reservoir including an upper portion, a lower portion, and at least one auxiliary air vent opening disposed in the upper portion of the at least one auxiliary reservoir, the at least one auxiliary air vent opening permitting the passage of air as the at least one auxiliary reservoir is filled and drained;

a sight gage fluidly coupled to the primary reservoir and the auxiliary reservoir, the sight gage including a tube having an upper end and lower end, the tube being substantially transparent, the sight gage further including a lower fitting fluidly coupling the lower end of the tube with the primary reservoir, and an upper fitting fluidly coupling the upper end of the tube with the primary reservoir; and a hose fluidly coupling the lower portion of the at least one auxiliary reservoir with the lower fitting of the sight gage whereby the sight gage fluidly couples the auxiliary reservoir and the primary reservoir to equilibrate fluid contained in the primary reservoir and the auxiliary reservoir as the pump draws fluid from the primary reservoir.

11. The milling machine of claim 10 further including a vent tube, the vent tube being fluidly coupled with the at least one auxiliary air vent opening and with the upper end of the tube of the sight gage whereby air may flow between the auxiliary reservoir and the primary reservoir as fluid equilibrates between the primary reservoir and the auxiliary reservoir.

12. The milling machine of claim 10 wherein the lower fitting includes a T-fitting having three openings, the tube of the sight gage, the hose, and the primary reservoir being fluidly coupled with respective ones of the three openings of the T-fitting.

13. The milling machine of claim 12 including a vent tube fluidly coupled with the at least one auxiliary air vent opening, and wherein the upper fitting includes a T-fitting having three openings, the tube of the sight gage, the vent tube, and the primary reservoir being fluidly coupled with respective ones of the three openings of the upper fitting whereby air may flow between the auxiliary reservoir and the primary reservoir as fluid equilibrates between the primary reservoir and the auxiliary reservoir.

14. A spray system for a milling machine including a drum rotatably mounted on a frame and configured to plane a road surface during operation, the spray system comprising:

at least one spray bank including a spray manifold and a plurality of spray nozzles;

a primary reservoir configured to be mounted on the frame and to enclose a volume of fluid;

a pump fluidly associated with the primary reservoir and configured to draw the fluid therefrom and to supply fluid drawn from the primary reservoir to the at least one spray bank;

at least one auxiliary reservoir configured to be coupled to the frame and configured to enclose a second volume of fluid, the at least one auxiliary reservoir including at least one auxiliary air vent opening disposed in an upper portion of the at least one auxiliary reservoir, the at least one auxiliary air vent opening permitting the passage of air as the at least one auxiliary reservoir is filled and drained;

at least one fluid connection fluidly coupling the auxiliary reservoir to the primary reservoir, the at least one fluid connection being fluidly coupled to a lower portion of the auxiliary reservoir; and at least one of the primary reservoir and the at least one auxiliary reservoir including at least one fill port configured to receive fluid to be enclosed within the primary reservoir and the at least one auxiliary reservoir;

such that the second the volume of fluid within the at least one auxiliary reservoir equilibrates with the volume of fluid within the primary reservoir as the pump draws fluid from the primary reservoir.

15. The spray system of claim 14 wherein the at least one spray bank is configured to be disposed proximal to the drum.

16. The spray system of claim 14 including a plurality of spray banks.

17. The spray system of claim 14 wherein the primary reservoir and the at least one auxiliary reservoir are configured to equilibrate through the at least one fluid connection such that both the primary reservoir and the at least one auxiliary reservoir may both be filled through the at least one fill port.

18. The spray system of claim 14 further including at least one vent tube fluidly coupling the at least one auxiliary air vent with the primary reservoir.

19. The spray system of claim 14 further including a sight gage, the sight gage providing a visual indication of a fluid fill level of primary reservoir, the sight gage being fluidly coupled with and extending from an external surface of the primary reservoir, and the at least one fluid connection being fluidly coupled to the sight gage.

20. The spray system of claim 19 further including at least one vent tube fluidly coupling the at least one auxiliary air vent with the sight gage.

* * * * *